United States Patent [19]

Kochanowsky

[11] 3,975,053

[45] Aug. 17, 1976

[54] MINING METHODS AS SUCH AND COMBINED WITH EQUIPMENT

[76] Inventor: Boris J. Kochanowsky, 426 Homan Ave., State College, Pa. 16801

[22] Filed: Dec. 3, 1973

[21] Appl. No.: 420,886

[52] U.S. Cl. ..... 299/7; 299/18; 299/19

[51] Int. Cl.[2] ..... E21D 1/03; E21F 13/00; E21C 41/06; E21C 47/00

[58] Field of Search ..... 299/7, 10, 19, 18, 15, 299/8; 37/195

[56] References Cited

UNITED STATES PATENTS

| | | | |
|---|---|---|---|
| 861,852 | 7/1903 | Hill | 37/195 X |
| 906,765 | 12/1908 | Anderson | 299/19 X |
| 1,980,634 | 11/1934 | Philips | 37/195 X |
| 3,098,641 | 7/1963 | Baldwin | 299/19 X |
| 3,349,848 | 10/1967 | Burgh | 166/259 |
| 3,385,068 | 5/1968 | Armentrout | 37/195 UX |
| 3,586,379 | 6/1971 | Lambly | 299/19 X |
| 3,692,364 | 9/1972 | Henriksson et al. | 299/19 X |
| 3,790,214 | 2/1974 | Kilroy | 299/17 |

FOREIGN PATENTS OR APPLICATIONS

| | | | |
|---|---|---|---|
| 536,728 | 10/1931 | Germany | 299/19 |
| 348,373 | 2/1922 | Germany | 19/ |

OTHER PUBLICATIONS

"Portable Crusher for Open Pit and Quarry Operations," B. J. Kochanowsky, *Mining Engineering*, Dec. 1960, pp. 299–318.

*Primary Examiner*—Ernest R. Purser
*Assistant Examiner*—William F. Pate, III
*Attorney, Agent, or Firm*—Thomas E. Sterling

[57] ABSTRACT

This invention comprises two improved mining methods as such and combined with mining equipments for the mining and rock industries. The first, called the screw-mining-method, comprises benches which rotate around a turning-point area in a downwardly sloping screw shaped path. The benches are positioned radially to the turning-point area which contains a shaft or other transportation means between two points located at different altitudes. The second, called a method with horizontal-radial-rotating benches, operates similarly to the first method except that the benches rotate solely in a horizontal plane rather than in a downwardly sloping path. The method and equipments are adapted for use with material such as rock, ore, coal and any other commercially useful, as well as mineral materials excavated from the earth's crust.

6 Claims, 26 Drawing Figures

(a) SURFACE MINING WITH CONVENTIONAL EQUIPMENT (b) SURFACE MINING WITH MOBILE CRUSHER AND CONVEYORS

MINING METHODS AS SUCH AND COMBINED WITH EQUIPMENT

This invention relates to mining methods and in particular to two improved mining methods, as such, and combined with equipment.

The principal improvements of the present invention are as follows: Through invention of "the screw-mining-method", the length of bench face is about six times shorter than in mining methods used now in surface mining of copper or other mineral materials. The screw-mining-method uses benches positioned radially to a turning-point area, where shaft or other transportation means between two points located in different altitudes are placed. These benches rotate around said turning-point area in a downwardly sloping screw-shaped path. Comparing the length of these benches with such used now in circus-shaped mines, where copper or other mineral material are mined, as mentioned, are about six times shorter. Through such reduction, the required investment of highly expensive conveyors are drastically reduced making application of mobile-crusher-conveyor system possible in the domestic mining and rock industries. This screw-mining-method and another one called "a method with horizontal-radial-rotating-benches" presented in this Application for patent, represent significant improvement in mining technology.

In both mentioned methods benches can be kept completely straight (not curved as it is used now in circus-shaped mines) and therefore application of conveyors is easily adaptable.

Since 1955 the inventor of the mining methods has been promoting "the mobile-crusher-conveyor system" for mining and rock industries. This has been done through publication of numerous papers in professional domestic and foreign magazines, through speaking engagement on the national and international congresses and through advising to the management of companies in the mining and rock industries, as well as to the manufacturers of mining equipments in the United States and Europe.

The usual step sequence of operation in surface mining is "drilling, blasting, loading, haulage and crushing". Haulage is normally accomplished by truck or track-mounted cars. By using "a mobile-crusher-conveyor system" the crushing stage occurs before haulage and sequence of operations is therefore "drilling, blasting, loading, crushing and haulage".

It is the principal object of this invention to provide a screw-mining method using radially positioned benches which rotate about a turning-point are in a downwardly sloping screw shape path.

It is another object of this invention to provide a mining method with a horizontal radial rotating bench, in which the benches rotate about a turning-point area on a horizontal plane.

It is another object of this invention to provide a method of mining where many benches are simultaneously operated.

It is yet another object of the present invention to provide an improved mining method combined with mining equipment, particularly with "mobile-crusher-conveyor system" to make mining operation more efficient and economic with drastical cut in costs of operation.

It is a further object of the present invention to permit the application of highly efficient "mobile-crusher-conveyor system" in domestic mining and rock industries.

It is another object of this invention to provide an efficient and highly economic operation to mine mineral material from earth's crust where blending of these materials is required.

It is still another object of this invention to provide a buffer in haulage of mined material located between the loading point on the benches and the point of final destination, making operation in transportation without costly interruptions and disturbances.

FIG. 1*a* is a cross sectional view of a conventional surface mining method with conventional equipment.

FIG. 1*b* is a cross sectional view of a conventional surface mining operation using a "mobile-crusher-conveyor" system.

FIGS. 2*a* and 2*b* are cross sectional and plan view of a conventional method of mining copper using circular or elliptical multi-benches.

FIG. 8 is a perspective view of the method of FIG. 7 used in conjunction with conventional equipment such as trucks, loading machine and the like.

Figure 9A:
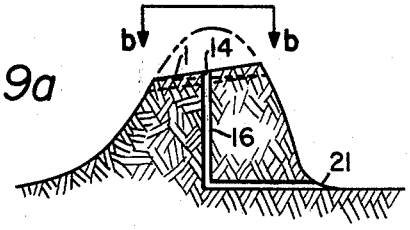
Figure 9B:
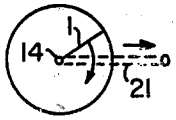
Figure 7:
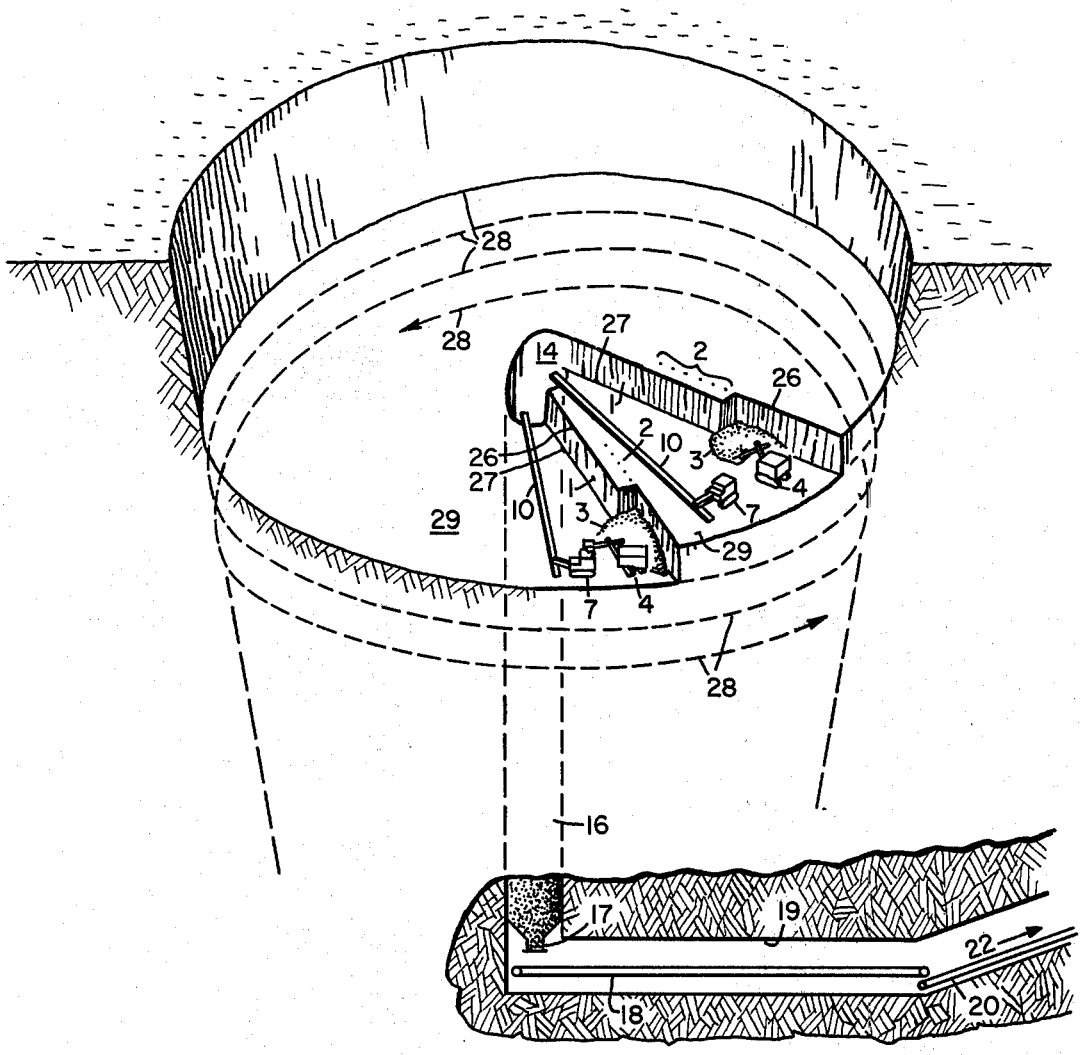
FIG. 7 is a perspective view of the screw-mining method used in conjunction with a mobile-crusher-conveyor system.
Figure 8:
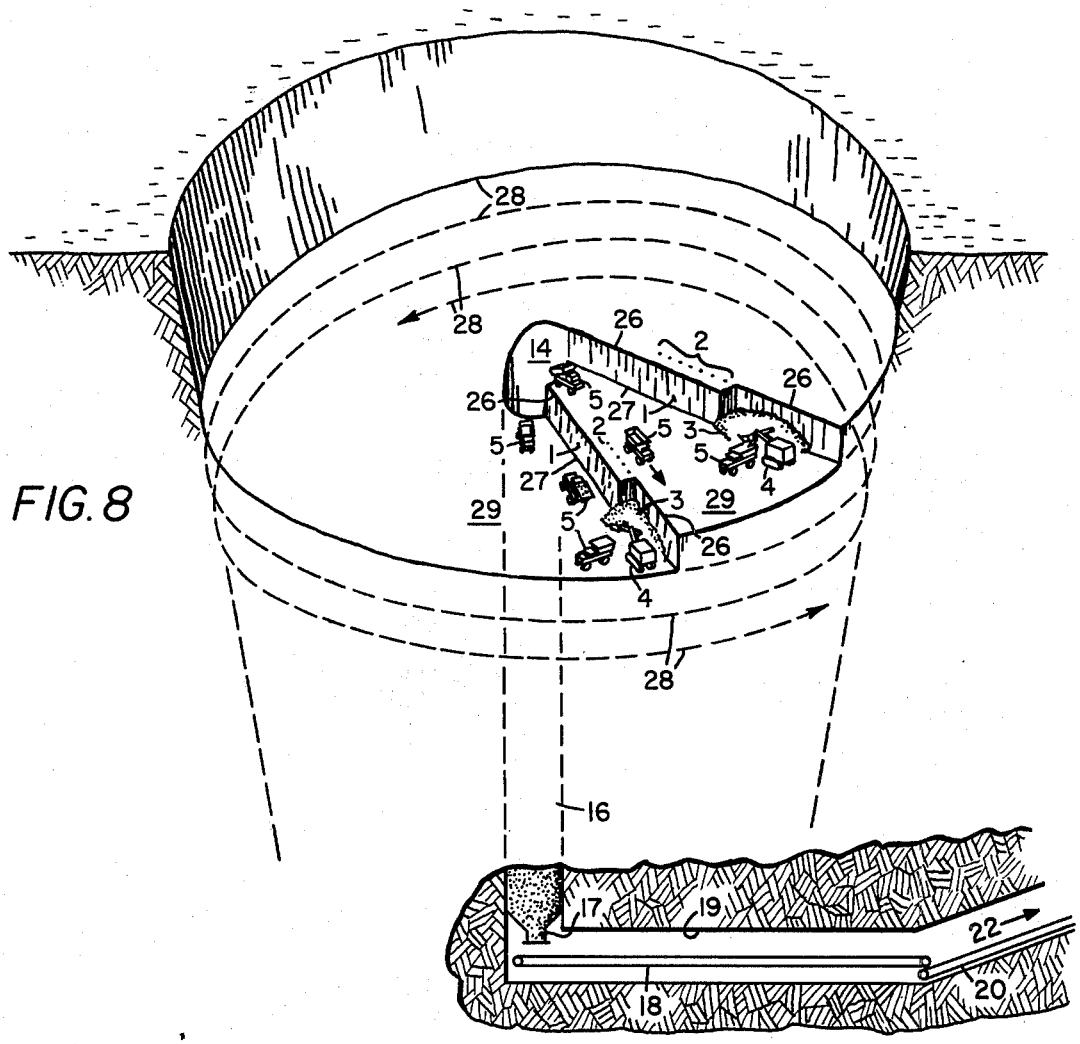

FIGS. 9*a* and 9*b* are cross sectional and plan views of the method of FIG. 7 and FIG. 8 as applied to the mining of a hill or mountain with a bench rotation of 360° and using a shaft and tunnel for ore transportation.

Figure 10A:
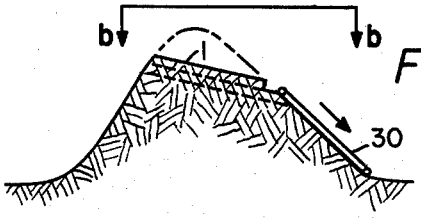
Figure 10B:
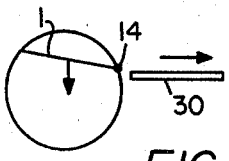

FIGS. 10*a* and 10*b* are cross sectional and plan views of the method of FIG. 7 and FIG. 8 with a bench rotation of 180°, and utilizing the slope of a hill for hauling.

Figure 11A:
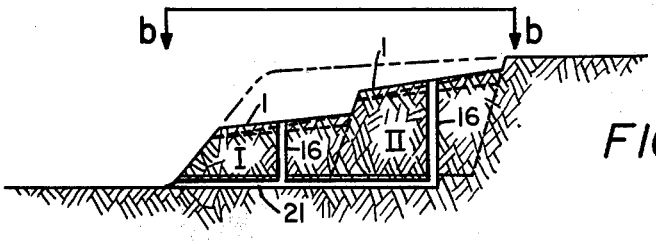
Figure 11B:
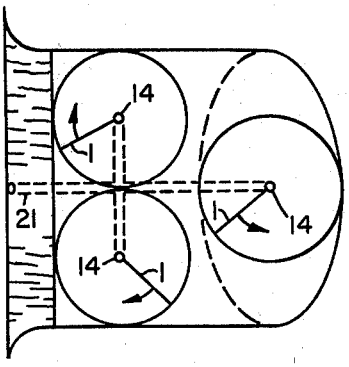

FIGS. 11*a* and 11*b* are a cross sectional view and plan view showing the mining methods of this invention on a large mining area.

Figure 12:
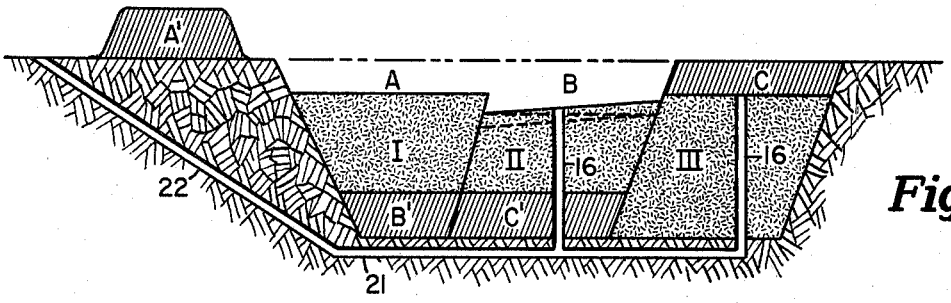

FIG. 12 is a cross sectional view of the utilization of mining methods of this invention on a deposit of minerals showing the method of depositing overburden.

Figure 13:
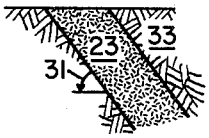

FIG. 13 is a cross sectional view of a deposit of ore which dips into the earth's crust at an angle.

Figure 14:
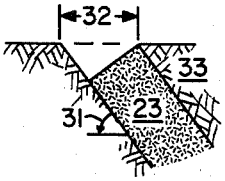

FIG. 14 is a cross sectional view of the deposit of ore of FIG. 13 showing a mined area when the width of the mining field is equal to the width of the outcrop.

Figure 15:
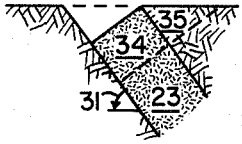

FIG. 15 is a cross sectional view of the deposit of ore of FIG. 14 showing the case when steril must be removed before mining the useful mineral.

Figure 16:
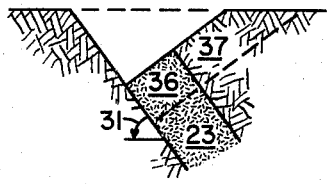

FIG. 16 is a cross sectional view of FIG. 15 for the mining of minerals at greater depths.

Figure 17A:
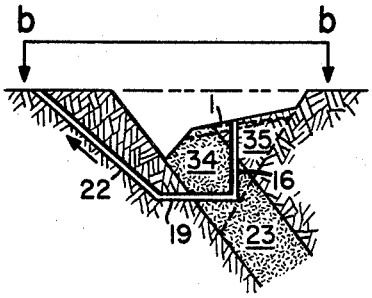
Figure 17B:
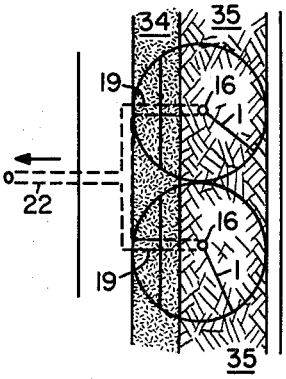

FIGS. 17*a* and 17*b* are cross sectional and plan view showing the method of this invention where mining of ore and steril occur with the same shaft or sets of shafts.

Figure 18A:
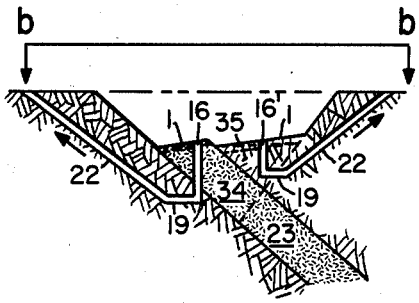
Figure 18B:
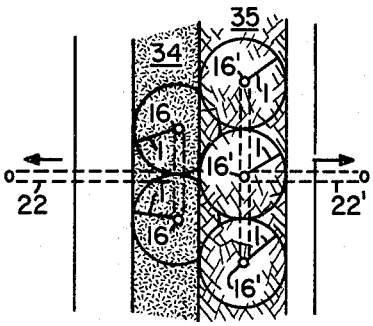

FIGS. 18*a* and 18*b* are cross sectional and plan view showing the method of this invention where mining of ore and steril occur using completely separate shafts or sets of shafts for transportation.

Figure 19:
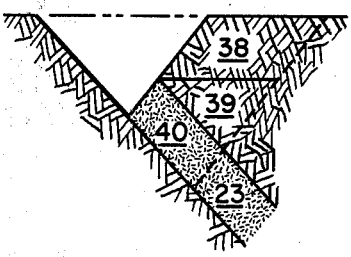

FIG. 19 is a cross sectional view showing the situation when steril must be removed before useful minerals are mined.

Figure 1A:
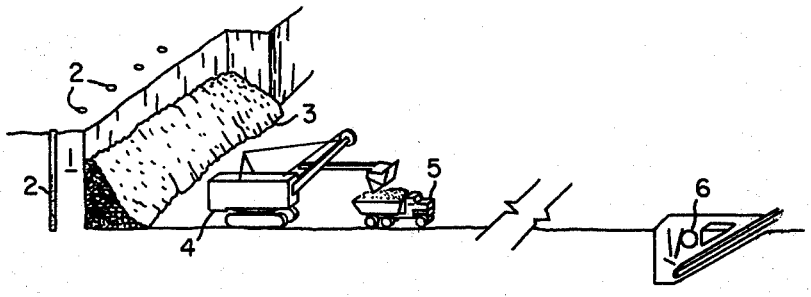
FIG. 1a PRIOR ART

The mining art prior to this invention may be seen by referring to the drawings and in particular to FIG. 1*a* where there is shown cross sectional view of a surface mining with conventional equipment. In hard rock bench 1 is blasted with explosive which fill borehole 2 drilled in this rock. Blasted material in a pile 3 is loaded by a loading machine 4 into truck 5 which transport this material to a stationary crusher 6. Crushed material is transported to rock storage or to treatment plant, where raw material is converted into a commercial product.

Figure 1B:
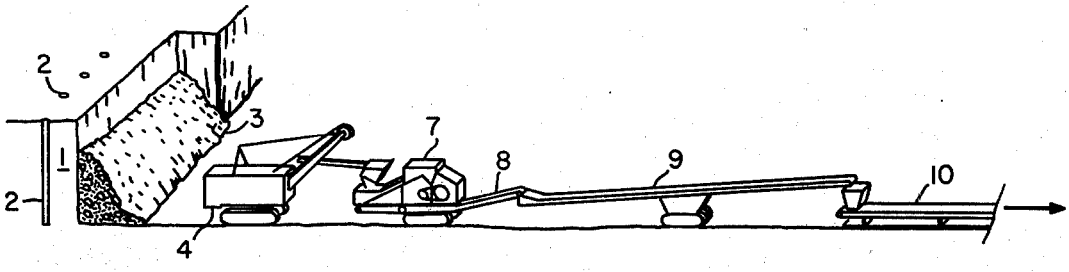
FIG. 1b PRIOR ART.

FIG. 1*b* shows cross sectional view of a surface mining operation where "a mobile-crusher-conveyor system" is used. Here blasted material from pile 3 is loaded by a loading machine into mobile crusher 7. Crushed material is deposited by a swinging conveyor 8, which is attached to the mobile crusher 7, either to a bridge conveyor 9 or direct to a stationary or semi-stationary conveyor 10. Conveyor 10 transports crushed material to a rock storage or to a treatment plant.

Semi-stationary conveyor 10 derives its name from the requirement to move this conveyor from time to time. This time interval can be as long as several months or several years. One or several bridge conveyors 9 between mobile crusher 7 and conveyor 10 permit higher flexibility in mobility of mobile crusher 7 and prolongation of time interval when semi-stationary conveyor 10 must be moved.

Figure 2A:
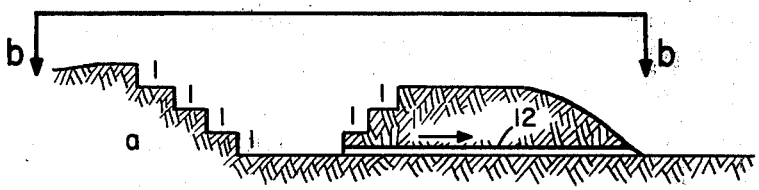
Figure 2B:
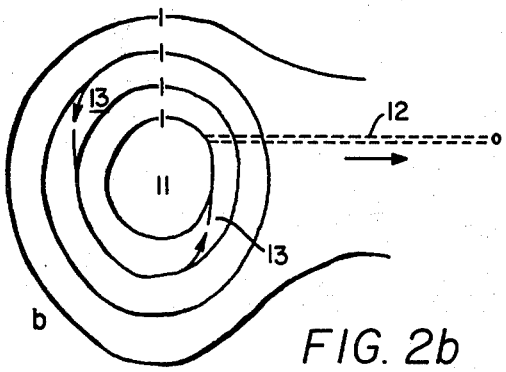

About 50 "mobile-crusher-conveyor plants" are operating now in different countries. Most of these plants are located in Europe. Great interest for this type of equipment has been shown in the domestic mining and rock industries. But not one plant of this type, where crusher is moving continuously following the loading machine, operates in the United States. Several projects to introduce "a mobile-crusher-conveyor system" in American copper mines failed, because of the shape of mines caused by the method and way of mining, and because of the requirement to blend the ore. FIG. 2*a* shows a cross sectional view and FIG. 2*b* a plan view of such a copper mine. Copper ore is mined with benches 1 of usually 30 to 60 foot height which are moving from the middle point 11 or middle axis of the pit to the outside toward the limits of mining field or towards to the limits of mineral deposit. The shape of the face of these benches 1 is mostly circular or elliptical, nor well adaptable for the use of conveyors because they are straight.

Transportation of ore from benches 1, which lack direct exit due to topography of the country, occurs through tunnel 12. To reach this tunnel 12 ore is transported down from bench to bench which are connected with sloped roads 13.

Even in the case when a group of two or three benches are operated with a single main conveyor located of one of these benches, which is connected with other benches by means of bridge conveyors 9, such a pit would need many long very expensive conveyors and bridge conveyors and required investment for such installation would be prohibitive. Most of the copper mines are hauling ore of different grades separately from different loading points to several places or to a point where ore of different grades is blended. This requirement may create serious difficulties for the use of "the mobile-crusher-conveyor system" if applied with conventional mining methods used now in the surface mining.

The invention presented here permits one to overcome all mentioned difficulties in the best way. Compared to circular or elliptical shape of bench faces the total length of conveyors for a pit will be six times shorter. The operation of mine can be accomplished with a maximum efficiency also in cases when blending of material extracted is required. Following this invention the movement of a bench or bench faces take place in form of "screw" or "spiral" and therefore this method of mining submitted for patent application is called "screw-mining-method" or "spiral-mining-method" or "screw-shaped-mining-method" or "spiral-shaped-mining-method".

Each bench face is placed radial to the point, which is located in or close to the center of a mining field, where one or several shafts are situated. These benches rotate clockwise or contra-clockwise around this turning-point. On each bench a conveyor is placed parallel to the bench face. Between bench face and conveyor is a mobile crusher. Because the length of a circle, which is equal to 2 R, compared to its radius R is $2\pi R : R = 2 \times 3{,}14 = 6{,}28$ times shorter, the total length of required conveyor for a pit is approximately six times shorter, and consequently, the required investment for conveyors will be six times smaller when "the screw-mining-method" combined with "mobile-crusher-conveyor system" is applied. Due to great reduction in investment and in labor costs, it will be possible for the domestic mining and rock industries to use this invention and cut operating costs drastically, especially where many benches are simultaneously mined in the conventional manner today. This improved efficiency in mining technique will increase the competitive strength of domestic economy and therefore this invention will be of great importance for this country.

Figure 3:
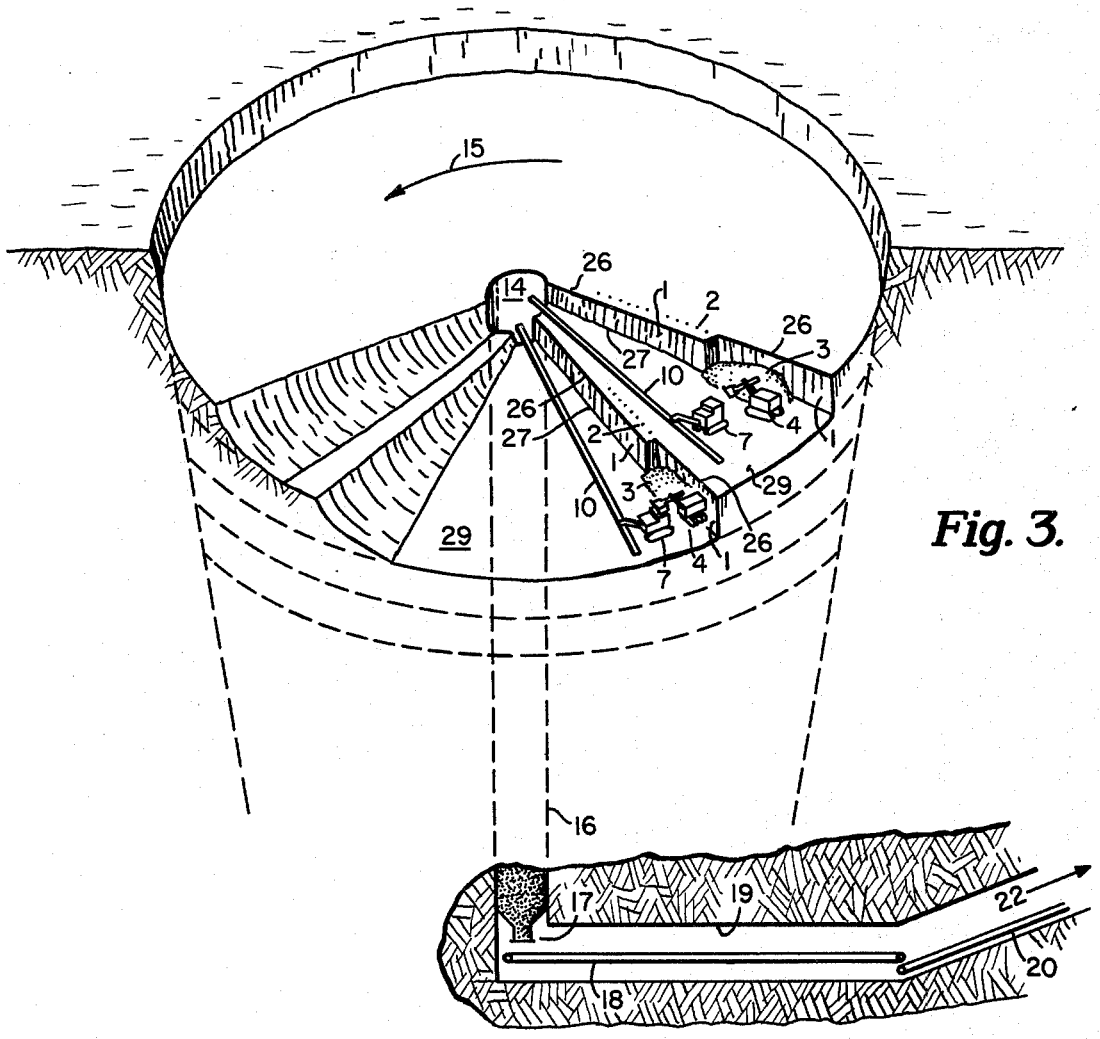
FIG. 3 is a perspective view of the horizontal-radial-rotating bench method of mining in combination with a mobile crusher.

The new methods of this invention as such and combined with mining equipments, may be seen by referring to FIG. 3 which shows a perspective view of a new mining method combined with mining equipment. One or several benches 1 are placed radial to the turning-point area 14 around which they rotate. The rotation of benches 1 around the turning-point area 14 occur clockwise or contra-clockwise 15. The length of benches 1 may vary between few feet and several thousands of feet or even several miles long. The height of benches 1 is usually between 20 and 60 feet, but it may vary between 5 and 300 feet and even more. To get a greater bench height, up to 1000 feet and more, a bench 1 must consist of several steps. From each step the blasted material is thrown down to the main floor, where mining equipment for loading, crushing and hauling are located. The width of steps depends upon the height of these steps. It depends also upon the type of equipment which is used to remove the blasted material from these steps. The width of steps is kept as short as possible, usually between 20 and 100 feet, but they can be wider by very high benches belonging to this particular step.

To throw blasted material down from the step to the main floor we use a bulldozer or any other machine capable to push or to load and carry mined material up to the edge of the step where it is unloaded.

One or several vertical or inclined shafts 16, or one or several closed or open chutes, or one or several pipes or other means of transportation are located in the turning-point area 14, through which mined material is transported usually downwards, seldom upwards.

Shafts or other means of transportation located in the turning-point area 14 are unloaded by means of feeders 17 into conveyor or conveyors 18 placed in one or in several tunnels 19 located underneath the shaft or shafts 16 or underneath other means of transportation. The mined material is then transported from conveyor 18 to main conveyor 29 from whence it travels to a desirable location.

Figure 4:
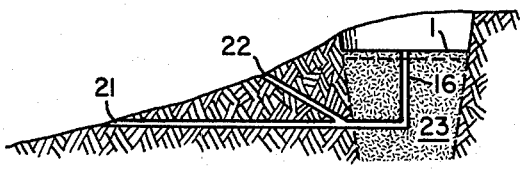
FIG. 4 is a cross sectional view of a transportation method where the main conveyor is placed in a horizontal or inclined tunnel.
Figure 5:
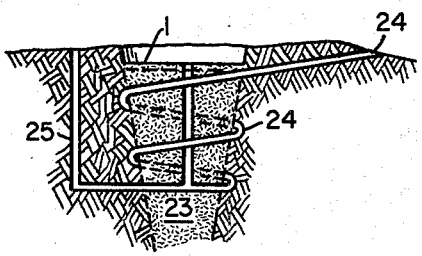
FIG. 5 is a cross sectional view of a transportation method wherein mined material is removed through an inclined drift encircling the mineral deposit or shaft.

FIGS. 4 and 5, shown in cross section, give different possibilities to transport mined material from shaft or other means of transportation located in the turning-point area 14 to the earth's surface. Depending on local conditions such as the topography of the country, shape of the deposit, etc., the main conveyor 20 is placed either in the horizontal tunnel 21 (FIG. 4) or in inclined drift 22 (FIG. 3). This drift 22 can go either straight to the earth's surface (FIG. 4) or inclined drift 24 can run around the deposit 23 (FIG. 5) or around the mining field. Different types of hauling equipment can be used in the tunnel 21 or in inclined drift 22. Economic safety considerations will be decisive for this selection, but belt conveyor will mostly be the best transportation means. In certain cases a shaft 25 with a hoisting machine can be used (FIG. 5). When mined material is of different quality and it must be blended, each particular quality can be deposited in a different shaft (or in other means of transportation) located in the turning-point area 14 which is assigned for this quality, and blending of these materials is made during unloading process of these shafts 16 (or of other means of transportation) located in the turning-point area 14.

The size of the angle of rotation of benches 1 depends upon the shape of mining field and upon the location of the turning-point area 14 in this mining field. It can be equal to 360°, to 180° or to any other angle between few degrees and 360°.

The best location of the turning-point area 14 in the mining field is such that assures the minimum changes in the length of the bench 1 during its rotation. This statement is of special importance when belt conveyors are used for haulage on the benches 1. When the bench 1 rotates 360°, the best location of the turning-point area 14 is in the center or close to the center of the mining field.

The shape of a mining field can be circular, elliptical or of any other form. The ideal case is a circular shape of mining field. In case it is impossible or not advisable to have a mining field in circular form and "mobile-crusher-conveyor system" is used, then the length of conveyor must be adjusted to each particular situation which may occur during the rotation of the bench 1. This can be accomplished in different ways:

A. By dividing conveyor in several independent sections. Depending upon the length of the bench face, which is changeable during its rotation, required number of sections of belt is used each time.

B. A conveyor of a certain length is applied. The part of the bench face, which can not be reached by this conveyor during bench rotation, can be handled by front loaders. These front loaders are capable of transporting mined material 3 from the loading point at the bench 1 up to mobile crusher 7 for several hundreds feet distance.

Figure 6:
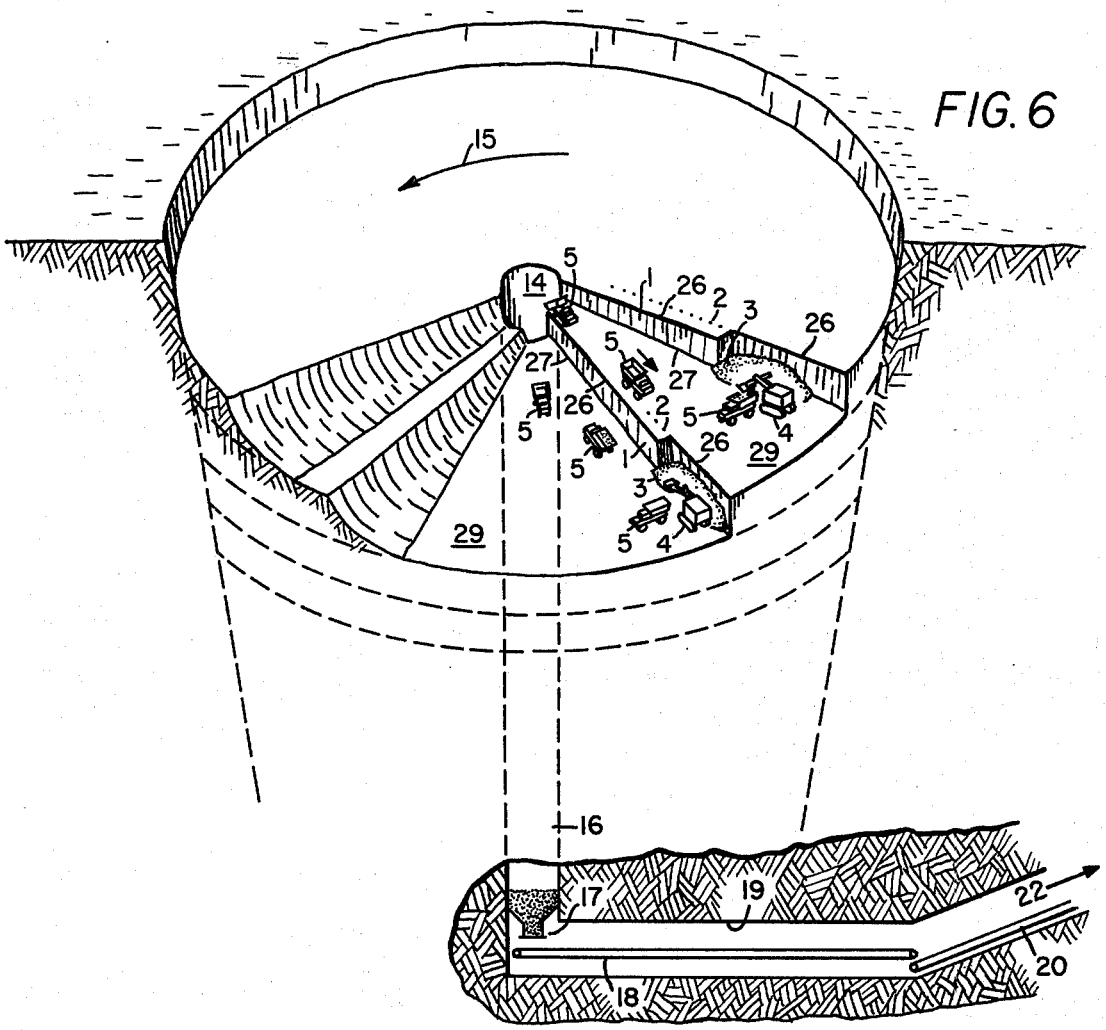
FIG. 6 is a perspective view of the method of FIG. 3 in which conventional equipment such as trucks, mechanical shovel, and the like are used for loading and transporting mineral material.

FIGS. 3 and 6 show a perspective view of a new mining method. In this case the altitude of each bench during its rotation remains constant. Because the edge 26 or toe 27 of the bench 1 stay in the same horizontal plane during the rotation of the bench, we call this method "A MINING METHOD WITH HORIZONTAL-RADIAL-ROTATING-BENCHES". After the bench 1 has been rotated up to maximum possible angle, which depends upon the shape of mining field and upon the location of the turning-point area 14 in this mining field, this bench 1 ceases to exist and a new bench 1 at the lower altitude must be developed.

"A mining method with horizontal-radial-rotating-benches" can be used either with "mobile-crusher-conveyor system" or with any "conventional equipments" like truck 5 or/and conveyor 10 or train loaded by any loading machine 4 with or without help of mobile crusher 7. When soft material is mined, blasting for breakage of material is not required and mobile crusher 7 is not needed.

FIG. 3 shows a perspective view of "mining method with horizontal-radial-rotating-benches" combined with "mobile-crusher-conveyer system". FIG. 6 shows a perspective view of the "mining method with horizontal-radial-rotating benches" conbined with "conventional equipment", such as mechanical shovel or loading machine 4 and trucks 5. Front loaders can also be used to load trucks 5 or conveyors 10.

As it is mentioned before, in a "mining method with horizontal-radial-rotating-benches", after the bench 1 has been rotated 360° or to maximum possible angle, it ceases to exist and a new bench 1 must be developed, and that is very costly. To avoid this inconvenience the following method has been invented: In this method, the altitude of each bench 1 during its rotation is continuously changing, as can be seen from FIG. 7, which gives a perspective view of this method. Each point located on the edge 26 or on the toe 27 of the bench 1 (FIGS. 3, 6) during the rotation of the bench 1 around the turning-point area 14 follows the line of spiral 28 and the berm 29 of the bench 1 follows the surface which has the shape of the screw or spiral 28 (FIGS. 7, 8). Therefore, this method can be called "THE SCREW-MINING-METHOD" or "spiral-mining-method" or "the screw shaped mining method" or "the spiral-shaped mining method". In the operation of this method, each bench 1 rotates many times around the turning-point area 14 until it reaches its lowest point, or near the bottom of the planned mining field. The development of a new bench 1 after each rotation is therefore not required. The cost for development of a new bench and for moving all equipment from the old to the new bench are saved and all inconveniences caused with the development of new bench shall not occur.

With each bench 1 rotation of 360°, the altitude of each bench 1 decreases for a certain magnitude which can be made equal to the height of the bench 1 or equal to any other desirable magnitude. For practical reasons it is advisable to make these changes in altitude of the bench 1 (therefore in altitude of the edge 26 and of the toe 27 of the bench 1) continuously in regular intervals, for instance, with each blast of boreholes 2.

The "screw-mining-method" can be used in combination with the "mobile-crusher-conveyor system" or in combination with "conventional mining equipments".

FIG. 7 shows a perspective view of "screw-mining-method" with a "mobile-crusher-conveyor system".

The conveyor 10 is usually placed parallel to the bench 1 and the mobile crusher 7 moved between the bench 1 and conveyor 10. In particular cases, especially when front loaders are used, mobile crusher 7 can also be located on the end of conveyor 10 and be moved parallel to the conveyor from its beginning up to its end.

After blasting, the blasted material or pile 3 is loaded by mechanical shovel or loading machine 4 into the mobile crusher 7. The crusher 7 discharges the broken material into conveyor 10 which transports it to the turning-point area 14 where the shaft or shafts 16 or other means of transportation are located. Instead of mechanical shovel, front loaders or any other type of loading machine can be used in the described system.

After bench 1 had been advanced for a certain distance, the conveyor 10 which continuously follows the bench 1, must be moved so that it can again be easily reached by a mobile crusher 7. Since this conveyor 10 is displaced from time to time, it can be called semi-stationary conveyor. To avoid often displacements of semi-stationary conveyor 10, one or several bridge-conveyors 9 (FIG. 1b) can be used. They are placed between semi-stationary conveyor 10 and mobile crusher 7. Bridge-conveyors 9 are mounted on wheels or crawlers and therefore can be moved very easily.

As it is mentioned before, conveyor 10 is usually placed parallel to the bench 1. However, any other layout of conveyor is also possible. For instance, a semi-stationary conveyor 10 may begin in the turning-point area 14 and run parallel to the bench 1. Additionally other conveyors are placed perpendicular to it or they swing around the point where they are attached to the semi-stationary conveyor 10.

Another way to avoid often displacements of semi-stationary conveyors is to use the front loaders, because they are capable to load and to carry mined material over several hundreds feet distance.

FIG. 8 shows a perspective view of "screw-mining-method" with "conventional mining equipment". Several trucks 5 or other hauling equipment transport mined material loaded by any type of loading machine from the pile 3 to the turning-point area 14 where shaft or shafts 16 or other means of transportation are located.

APPLICATION OF INVENTION

The application of this invention is the simplest when the mineral deposit to mine has a shape of a hill or mountain, which can be entirely extracted. All operations occur in these cases in the orebody itself and removing of overburden through stripping operation is not required. These cases are given in FIG. 9 and FIG. 10. Both these figures are showing the cross sectional view of the upper part and a plan view in the lower part. In FIG. 9, bench 1 is turning 360° around the turning-point area 14. In FIG. 10, bench 1 rotates 180° around turning-point area 14. Ore is transported through shaft 16 and tunnel 21.

Depending on the size of the mountain, its extraction can be accomplished with one or with several independent units of shafts located in different turning-point areas 14.

In order to save cost to build shafts 16 (or other means of transportation) located in turning-point area 14 within the deposit, the hauling equipment 30, which serves to this purpose, can be placed on the surface upon the natural slope of the mountain, which can be accommodated for this goal if required (FIG. 10).

FIG. 11 shows a cross sectional view in the upper part and plan view in the lower part. It represents a deposit of ore, rock or other mineral material to mine which has a large three-dimensional extension especially in width and length, with none or little overburden on it. It is pure economics based upon the feasibility studies which will determine the horizontal and vertical dimension and shape of each mining field belonging to each set of shafts 16 or other means of transportation located in turning-point areas 14. The same way the decision will be made concerning the question with how many mining fields units the whole deposit will be extracted and what will be the sequence of operation of these mining field units.

As has been shown in FIGS. 9 and 10, the shaft 16 in the mining field I can be saved by placing the hauling equipment directly over the natural slope of the earth's surface. This hauling equipment would transport mined material from the hill down.

FIG. 12 shown a cross sectional view of a deposit of mineral to mine with overburden A, B, and C on it and how this overburden can be deposited in the previously mined space. It is assumed that the deposit section I has been mined first, then the deposit section II and finally the deposit section III. Overburden section A has been deposited in the place A′, overburden section B in the place B′ and overburden section C in the place C′.

Transportation of mined commercially utilized mineral from the bench 1 occurs through shaft 16, tunnel 21 and inclined drift 22. FIG. 13 shows a cross sectional view of deposit of ore or other mineral material 23 to mine which dips under a certain angle 31 in the earth's crust. As it can be seen from the cross sectional view in FIG. 14, when the selected width or length of the mining field is equal to the width 32 of the outcrop of this deposit 23, useful mineral can be extracted without stripping of steril material 33 in overburden.

As it is shown in cross sectional view in FIG. 15, by going deeper, steril material 35 must be removed before the useful mineral 34 can be extracted. Greater the depth up to which ore or other useful mineral must be mined, more overburden per ton useful mineral material must be removed. This can be seen from the cross sectional view in FIG. 16. To mine ore or useful material 36, overburden 37 must be stripped first. Volume of overburden 37 in FIG. 16 is bigger than the steril material 35 in the FIG. 15.

It is economics based upon feasibility studies which determine if the useful and steril mineral material will be mined with the same or with separate shaft or set of shafts placed in the turning-point area 14. The same way the decision will be made concerning the size, shape and number of mining fields units and sequence of their exploitation.

In FIG. 17 a cross sectional view is given in upper part and plan view in lower part of this figure. In this FIG. 17, ore or other useful mineral 34 and steril 35 are mined with the same shaft or sets of shafts 16 (or other means of transportation) placed in the turning-point area 14. In case only one shaft (or other means of transportation) is available, it must be emptied first before the change in type of material (meaning useful or steril), which is mined and transported through this shaft, takes place.

To make operation in transportation simpler, it is more convenient to have at least two shafts (or other means of transportation) located in turning-point area 14, one for useful mineral and another for steril. Transportation of useful mineral and of steril occurs through shaft 16, tunnel 19 and inclined drift 22.

FIG. 18 shows a cross sectional view in upper part and plan view in lower part. In this FIG. 18, mining of useful mineral and of steril is made by a completely separate shaft or sets of shafts (or other means of transportation) located in turning-point areas 14. Transportation of useful mineral 34 takes place through shafts 16, tunnels 19 and inclined drift 22 and transportation of steril material occurs through shafts 16', tunnel 19' and inclined drift 22'.

FIG. 19 shows a cross sectional view. From FIG. 19 it can be seen, that steril material 38 must be removed before steril 39 is mined. In case steril 39 and ore or other useful mineral material 40 are mined at the same time, the useful mineral material 40 and steril 39 can be mined with the same or with separate shaft or sets of shafts (or other means of transportation) placed in turning-point areas 14, as it has been explained before.

The advantages of the present invention over conventional methods may be clearly seen. Through crushing the rock or ore before hauling, it is possible to replace truck through conveyor, which permits a continuous, almost fully automated operation with all its attended advantages. Compared with conventional methods and equipment used now in surface mining, "the mobile-crusher-conveyor system" permits to increase a man-hour output several hundred percent, and to reduce power consumption and maintenance of hauling equipment. Foggy weather, icy roads which make the use of truck extremely hazardous or impossible is of no effect to conveyor haulage. With the largest mobile crusher it is possible to obtain an output in loading, crushing and hauling combined together over 1,000 tons per man-hour, or about 50,000 tons per day with a total of six men in a day of three shifts. To illustrate the importance of this output increase the following example is given. Now-a-days, a pit with long up-hill haulage roads, which produces 200,000 tons of copper ore per day requires for loading and hauling operations 200 to 250 men, whereas with "mobile-crusher-conveyor system" 24 to 30 men only.

I claim:

1. In a mining method for the extraction of rock, ore, coal or other mineral materials from the earth's crust, comprising in combination:

a turning-point area, said turning-point area having two or more shafts for storage and depositing said mineral material to create a buffer in haulage between the loading point at the bench and the point of final destination of mined material;

a bench from said turning-point area proceeding radially and positioned on an area to be mined;

a transportation tunnel connected to said shafts;

means to transport mined minerals material through said tunnel to outside, the process comprising in combination:

mining said bench which is radially positioned and which rotates about said turning-point area in a downwardly sloping screw-shaped path;

depositing mined or mineral material of different quality in different shafts and blending the deposited mined material from these shafts at the emptying point of said shafts in said tunnel;

removing said mined mineral material from said shafts through said tunnel.

2. In a mining method for excavation of rock, ore, coal or other hard material from the earth's crust comprising in combination:

a turning-point area in which two or more shafts are used for storage and depositing of said mineral material to create a buffer in haulage between the loading point at the bench and the point of final destination of mined material;

a bench from said turning-point area proceeding radially and positioned on an area to be mined;

a transportation tunnel connected to said shafts;

means to transport mined materials through said tunnel to the outside, the process comprising in combination:

mining said bench which is radially positioned and which rotates about said turning-point area in a horizontal plane;

depositing mined mineral material of different quality in different shafts and blending the deposited mined material from these shafts at the emptying points of said shafts in said tunnel;

removing said mining mineral material from said shafts through said tunnel.

3. In a mining method for extraction of rock, ore, coal or other hard mineral material from the earth's crust, comprising in combination:

a turning-point area in which two or more shafts are used for storage and depositing said mineral material to create a buffer in haulage between the loading point at the bench and the point of final destination of mined material;

a bench or benches from said turning-point area proceeding radially and positioned on an area to be mined;

a transportation tunnel underneath of said shafts;

means to transport mined materials through said tunnel to the outside, the operating process comprising in combination:

mining said bench or benches which radially positioned and which rotate around said turning-point area in a downwardly sloping screw-shaped path;

extraction of mineral material from the bench through drilling and blasting or through any other method used for fracturing hard mineral material;

loading extracted mineral material at the bench;

transporting mineral material to the shafts;

depositing mined mineral material of different quality in different shafts and either blending the deposited mined material from these shafts at the emptying point of said shafts in said tunnel or transporting these materials separately to final destination;

removing said material from said shafts;

transporting said material from said shafts through tunnel.

4. The method combination is claimed in claim 3, in which material is crushed and transported by a mobile-crusher-conveyor system which deposits mined mineral material in said shafts.

5. In a mining method for extraction of rock, ore, coal or other hard mineral material from the earth's crust, comprising in combination:

a turning-point area in which two or more shafts are used for storage and depositing said mineral material to create a buffer in haulage between the loading point at the bench and the point of final destination of mine material;

a bench or benches from said turning-point area proceeding radially and positioned on an area to be mined;

a transportation tunnel underneath of said shafts, the operating process comprising in combination:

mining said bench or benches which are radially positioned and which rotate about said turning-point area in a horizontal plane;

extraction of mineral material from the bench through drilling and blasting or through any other method used for fracturing hard mineral material;

loading extracted mineral material at the bench;

transporting said mineral material to the shafts;

depositing mined mineral material of different quality in different shafts and either blending deposited mined material from these shafts at the emptying point of said shafts in said tunnel or transporting these materials separately to final destination;

removing said material from said shafts;

transporting said material from said shafts through tunnel.

6. The method combination as claimed in claim 5, in which material is crushed and transported by a mobile-crusher-conveyor system which deposit mined mineral material in said shaft or shafts.

* * * * *